114-242 SR
12/8/87 XR 4,711,196

United States Patent [19]

Wilks

[11] Patent Number: 4,711,196

[45] Date of Patent: Dec. 8, 1987

[54] MARINE SURVIVAL SYSTEM

[75] Inventor: Thomas M. Wilks, Lymington, United Kingdom

[73] Assignee: Laggan Marine Developments Limited, Lymington, United Kingdom

[21] Appl. No.: 934,845

[22] Filed: Nov. 25, 1986

Related U.S. Application Data

[63] Continuation-in-part of Ser. No. 813,371, Dec. 26, 1985, abandoned.

[30] Foreign Application Priority Data

Jan. 7, 1985 [GB] United Kingdom ..... 8500359

[51] Int. Cl.[4] ..... B63B 23/00

[52] U.S. Cl. ..... 114/365; 114/242; 114/253; 114/144 A; 414/137

[58] Field of Search ..... 114/365–369, 114/377–379, 242, 246, 253, 254, 144 A, 144 RE, 348, 258–260; 414/137, 138, 139, 140; 441/80, 87

[56] References Cited

U.S. PATENT DOCUMENTS

| | | | |
|---|---|---|---|
| 1,485,280 | 2/1924 | Lyda | 114/365 |
| 3,026,545 | 3/1962 | Brainard, II | 114/144 A |
| 3,789,792 | 2/1974 | Smith | 440/67 X |
| 3,952,681 | 4/1976 | Tucker | 114/144 A |
| 3,980,038 | 11/1976 | Dashew et al. | 114/144 A |
| 4,360,348 | 11/1982 | De Marco | 440/67 |
| 4,395,178 | 7/1983 | MacDonnell et al. | 414/138 |

FOREIGN PATENT DOCUMENTS

| | | | |
|---|---|---|---|
| 2017958 | 10/1971 | Fed. Rep. of Germany | 114/254 |
| 2330587 | 11/1975 | France | 114/254 |
| 2532612 | 3/1984 | France | 114/368 |
| 2123353 | 2/1984 | United Kingdom | 441/87 |

*Primary Examiner*—Jeffrey V. Nase
*Assistant Examiner*—Paul E. Salmon
*Attorney, Agent, or Firm*—Shoemaker and Mattare, Ltd.

[57] ABSTRACT

On launch of a lifecraft from a marine platform or other vessel, an electrically powered tug connected to the lifecraft by stowed cable aligns the lifecraft away from the platform and tows it away from the platform in a predetermined attitude and track. In this way, the lifecraft is controlled in the hazardous initial period between launch and start of its own powered movement. The tug is advantageously stowed and launched bows-out and has an autopilot responsive to deviation of the towline from the tug fore-and-aft line to correct the tug helm so that the tug not only follows a predetermined compass heading but follows a predetermined track relative to the lifecraft. In a preferred version of the tug a portion of the towline is stored between a pair of sheave blocks biased towards one another to bring about towline retraction so that the towline is paid out as the tug is lowered and retracts into the tug during initial movement of the lifecraft with the tug still in the water and acting as a sea anchor.

17 Claims, 16 Drawing Figures

MARINE SURVIVAL SYSTEM

FIELD OF THE INVENTION

This application is a continuation-in-part of application Ser. No. 813371 filed Dec. 26, 1985, now abandoned.

The invention relates to a marine survival system in which a lifeboat, rescue craft or like small boat is launched from a ship, floating or fixed offshore marine platform or other vessel by which it is carried.

Launching a survival craft from an offshore platform for emergency escape can be in the face of a combination of adverse circumstances, e.g. with the platform listing, in the dark, into dense smoke, into fire on the sea, into a toxic or flammable gas cloud, into high winds or against adverse tides. It is therefore desirable to launch the survival craft positively away from the platform and in a bows-out heading.

DESCRIPTION OF PRIOR ART

One method that has been suggested is to launch the craft from a downwardly inclined chute extending partway from the platform to the sea, the remainder of the distance being traversed in free fall. Although this system can launch a boat away from a platform at a desirable heading and at a useful speed, it is expensive to install and subjects the passengers to high g-loads. In patent specification No. GB-A-2142310 there is described a method that involves providing a flexible boom mounted on a hinge secured to the parent vessel adjacent to the stowed survival craft. When not in use the boom is secured in some way so as not to interfere with the working of the parent vessel. A so-called "tagline" is attached at one end to the outboard end of the boom and is secured at its other end to the bow of the survival craft. In operation all personnel embark into the survival craft wearing lifejackets and secure themselves with seatbelts. All doors and hatches are closed and the engine is started. Lowering is activated from within the craft, and as it starts to descend the tension thus induced in the tagline causes the boom to hinge outwards and downwards to take up an approximate horizontal position pointing away from the platform. As the craft continues to descend further the tagline causes the boom to flex downward like a giant fishing rod until the craft is waterborne. At this point the engine throttle may be opened to full ahead, the lifting hooks released, and the tagline continues to exert a pull on the bow of the craft in an upward and outward direction until the craft has travelled the length of the boom away from the platform. Only then, when the bow of the craft is directly under the tip of the boom, is the tagline released, by which time the propulsion unit will have attained its maximum thrust and the craft will have reached a speed in excess of six knots.

The above launching system is not suitable for all situations and in particular it is difficult to retro-fit to existing lifecraft installations and it is an object of this invention to provide a compact launching system that can be fitted inexpensively to both new and existing installations.

U.S. Pat. No. 3,980,038 describes a tug for keeping a hose and mooring line extending from a single buoy mooring terminal in a desired direction but the tug relies on signals from the buoy to maintain its direction. Such an arrangement cannot be accepted for a survival craft which is required to operate independently of power on the vessel from which it is launched.

SUMMARY OF INVENTION

Broadly stated the invention provides a marine survival system for a vessel (including a marine platform) comprising:

a lifecraft:

an unmanned tug:

a towline connected between the bows of the lifecraft and a center of neutral steer of the tug;

a first launching means by which the lifecraft is stowed on the vessel, said first launching means including releasable falls and braked winch means controlling pay-out of the falls so that the lifecraft is lowered slowly to the sea:

a second launching means by which the tug is stowed on the vessel, said second launching means including a release permitting the tug to drop to the sea;

autopilot means in said tug operatively connected to a rudder of the tug to angle the rudder as called for by a predetermined compass heading;

a sensor in the tug responsive to the direction of pull in the towline to change state depending upon the magnitude and direction of the deviation of said pull from the fore and aft direction of the tug;

a trim control of the autopilot means responsive to the state of the sensor to adjust the effective compass heading to maintain the tug on a predetermined track relative to the lifecraft; and release means operably connected to the winch means and to the tug release so that on actuation of the release means the tug falls into the sea and deploys to the extremity of the towline on the predetermined heading and track as the lifecraft is slowly lowered to the sea and on release of the falls tows the lifecraft away from the vessel.

The invention further provides a method of launching a lifecraft from a vessel comprising the steps of:

controllably lowering the lifecraft from a stowed position to the water;

after the start of lifecraft lowering, launching a tug that is controlled by station keeping means to travel away from the vessel at a predetermined heading and track and is connected to the lifecraft by a stored towline that deploys as the tug starts its travel; and after the lifecraft has been lowered, towing it from the platform on the controlled heading and track by means of the tug.

The invention further provides a tug storing a section of towline that is paid out and recovered by biasing means so that the tug acts as a sea anchor with the towline fully deployed and recovers towline as the lifecraft begins to move away from the vessel from which it is launched.

In a further aspect the invention provides an unmanned tug for incorporation into a marine survival system which when dropped into the water deploys at the end of a towline on a predetermined heading and track relative to a lifecraft, said tug having autopilot means therein operatively connected to a rudder of the tug to angle the rudder as called for by a predetermined compass heading, a sensor in the tug responsive to the direction of pull in the towline to change state depending upon the magnitude and direction of the deviation of said pull from the fore and aft direction of the tug, a trim control of the autopilot means responsive to the state of the sensor to adjust the effective compass heading to maintain the tug on the predetermined track relative to the lifecraft, means in the tug for paying out and recovering a portion of the towline and means biasing the towline payout means in the recovery direction while towline is paid out to maintain a tension therein which is less than the pull of the tug when the tug is still in the water so that in use of the tug the towline is initially paid out and as the survival craft starts to move towards the tug the towline part is recovered into the tug with the tug substantially still in the water.

BRIEF DESCRIPTION OF DRAWINGS

Various embodiments of the invention will now be described, by way of example only, with reference to the accompanying drawings, in which.

DESCRIPTION OF PREFERRED EMBODIMENT

Figure 1A:
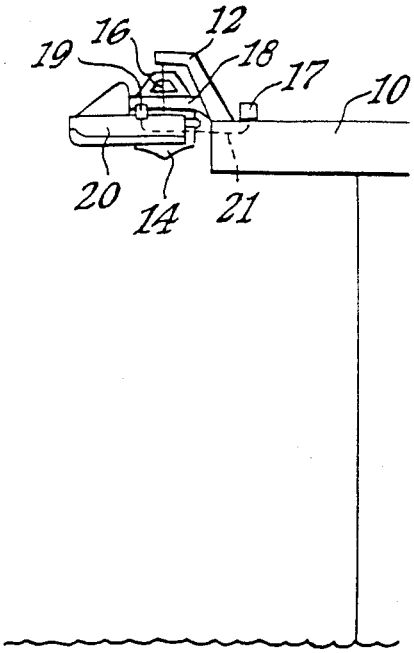
FIGS. 1*a* to 1*d* represent successive stages in the tug-assisted launch of a lifecraft according to the invention and FIG. 1*e* represents the start of the recovering of the lifecraft by a rescue ship.
Figure 1B:
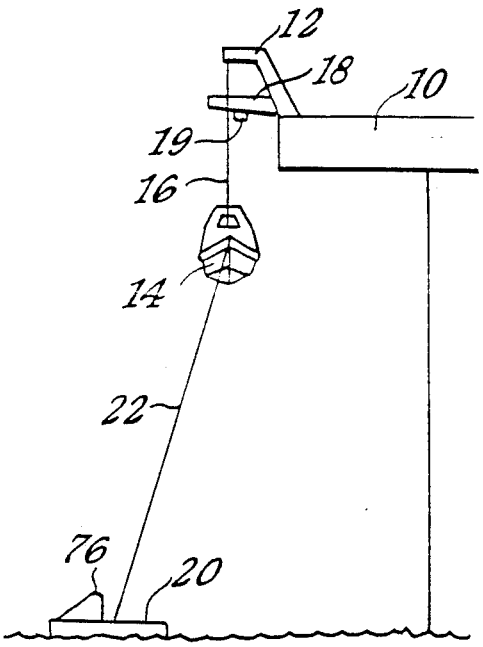
Figure 1C:
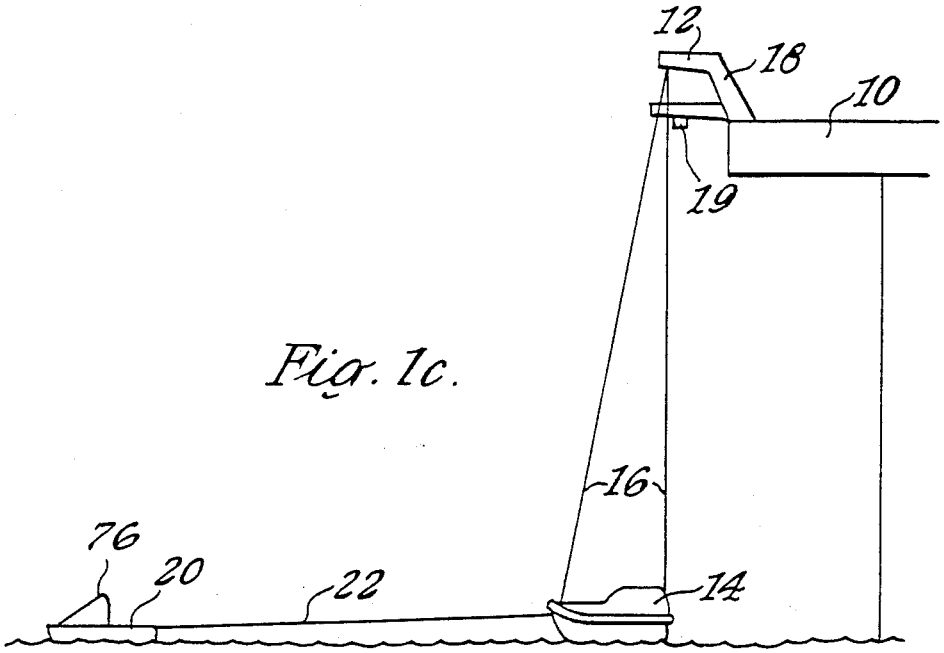
Figure 1D:
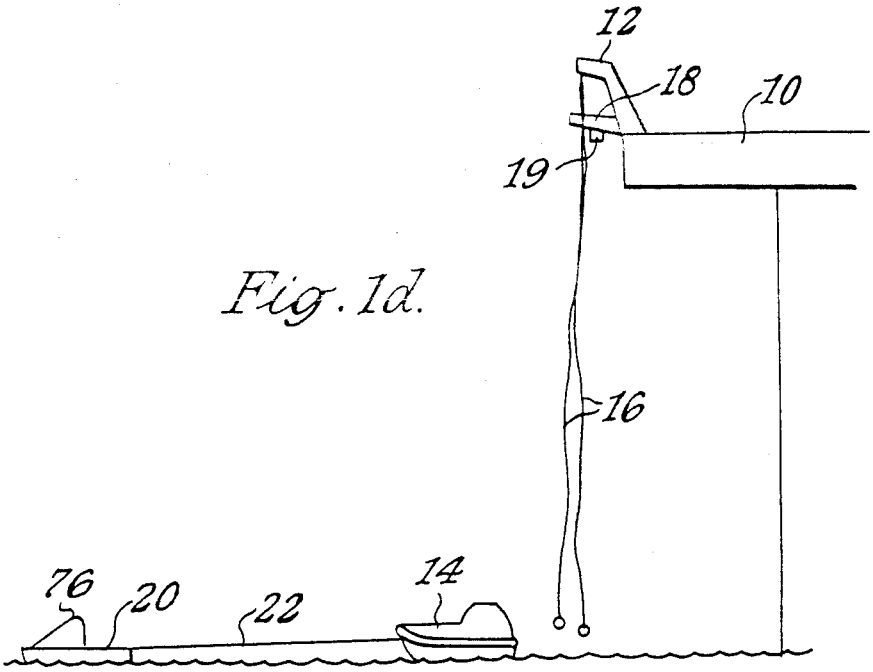
Figure 1E:
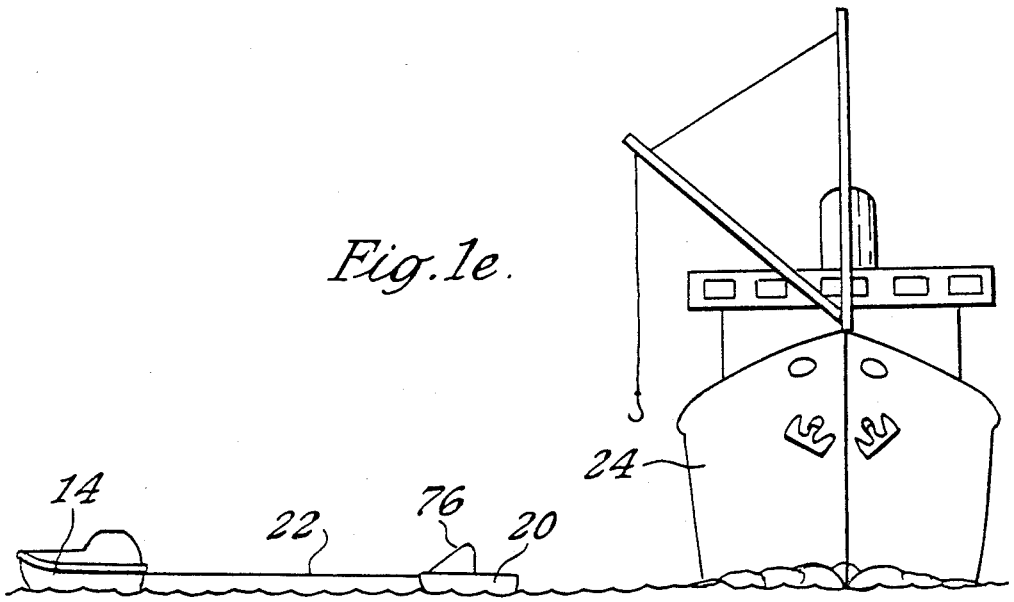
Figure 2:
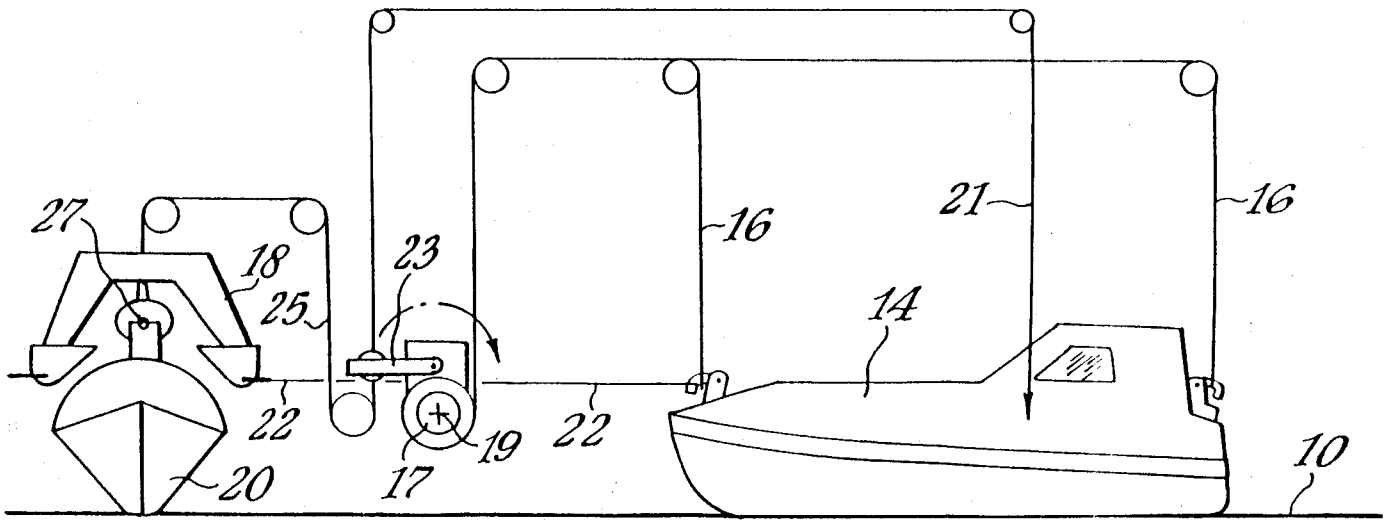
FIG. 2 is a diagram of the tug and lifecraft stowed prior to launch showing cables that provide for simultaneous launch of the tug and initiation of lifecraft descent.

In FIGS. 1*a* to 1*d* a marine platform 10 has a first davit structure 12 from which a lifecraft 14 is supported by mean of falls 16 controlled by winch means 17 (FIG. 2). The lifecaft 14 may be carried in an alongside attitude with respect to the platform 10 as shown or it may be carried in a bows-out attitude. A second davit structure 18 adjacent the davit structure 12 carries a tug 20 in a bows-out attitude with respect to the platform 10. The tug 20 may alternatively be stowed in a downwardly and outwardly inclined launching chute located adjacent the davit structure 12. During launch passengers enter the craft 14 and start the launch procedure by releasing a brake 19 in winch means 17 by pulling on cord 21 attached to brake actuation and release lever 23 after which the craft 14 begins a controlled descent. As the brake 19 is released the movement of lever 23 is transmitted via cord 25 to release mechanism 27 holding the tug 20 in position below the second davit structure 18, and the release mechanism 27 drops the tug 20 into the sea on a bows-out heading with respect to the platform 10. The tug motor starts on release and the tug 20 proceeds away from the platform 10 on a predetermined heading maintained by station keeping means therein. A towing cable 22 deploys from the tug and is permanently connected to the bows of the craft 14, the condition where the craft 14 has been partly lowered being as shown in FIG. 1*b*. In FIG. 1*c* the craft 14 has been fully lowered and pulled by the tug 20 into a bows-out heading, after which the falls 16 are released and the tug 20 pulls the craft 14 away from the platform 10 (FIG. 1*d*). A motor in the craft 14 is started when the craft 14 is afloat and as the craft 14 gathers speed the tug 20 is no longer needed. The towline 22 may be held permanently in a release hook at the bows of the craft 14 while the tug 20 and craft 14 are stowed, and when the tug 20 is no longer required the release hook may be operated either manually from within a passenger compartment of the craft 14 or by means of a timer to ship the tug 20 after which the craft 14 proceeds under its own power. Advantageously, however, the tug 20 is retained and towed by the craft 14 after its motor has ceased to operate, the tug 20 then acting as a buoy marking the end of a deployed towline 22 that can easily be picked up by a rescue ship 24 as in FIG. 1*e*.

Figure 3:
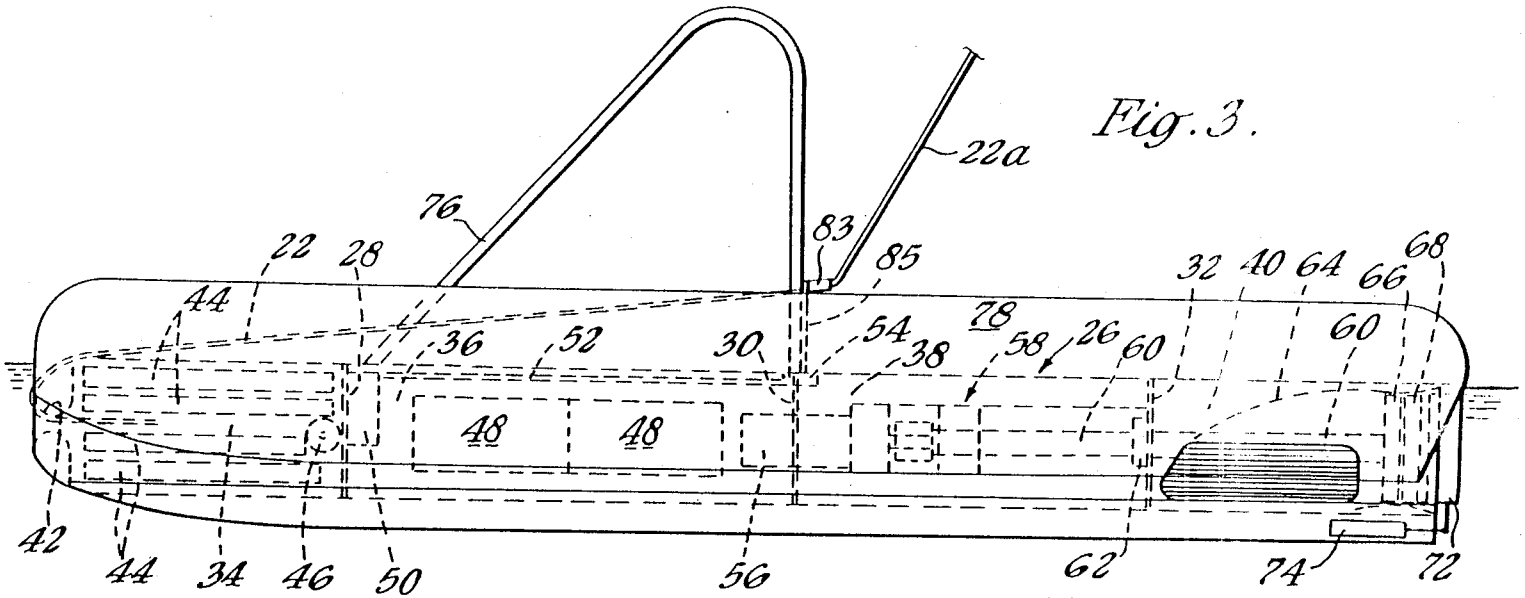
FIGS. 3, 4 and 5 are respectively a diagrammatic side elevation, top plan and rear elevation of a first embodiment of the tug forming part of a launching system according to the invention.
Figure 4:
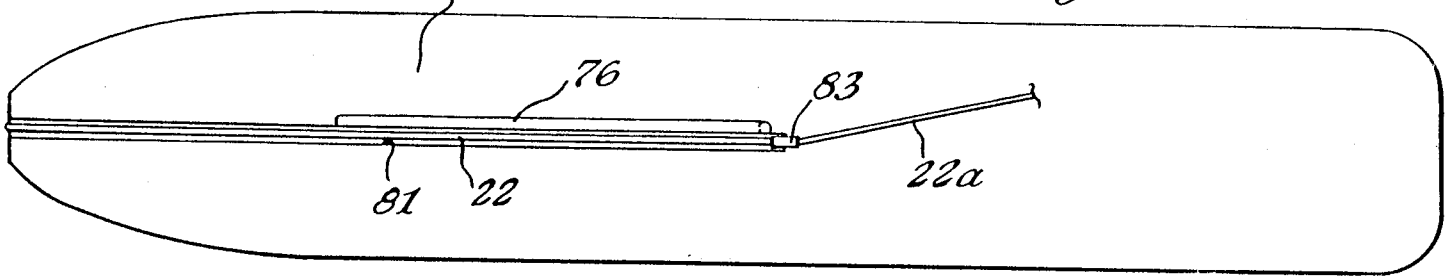
Figure 5:
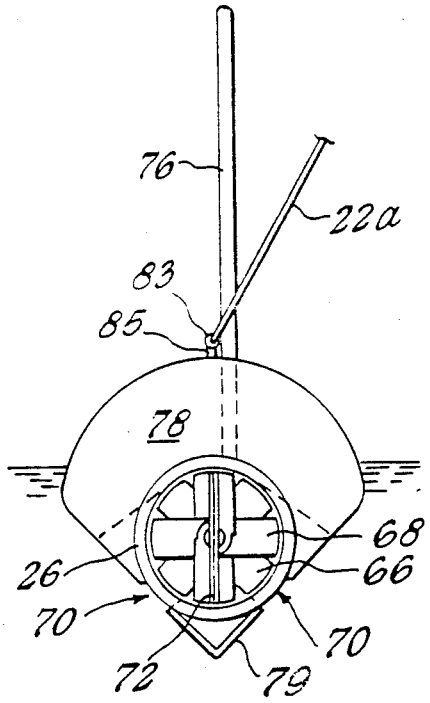

The structure of the tug 20 is shown in more detail in FIGS. 3 to 5. A casing or body 26 of generally cylindrical section is divided at transverse bulkheads 28, 30, 32 into a bow compartment 34, a forward compartment 36, an aft compartment 38 and a stern compartment 40. The bow compartment 34 has a suitable length such as 40 meters of tow rope or cable 22, most of which is held in serpentine manner in stowage tubes 44, but the last 15 meters of which are held on a tension reel 46. Accordingly the rope 22 will pay out freely from the compartment 34 as the tug deploys and the tension reel 46 serves to apply the towing load on the rope 22 gradually rather than with a sudden shock. The rope 22 emerges via a bows aperture 42 which is of rounded section as shown so that the rope 22 does not catch or fret. The forward compartment 36 contains high discharge rate batteries 48 which may be silver/zinc batteries and should be capable of giving a current of the order 300 amps at 100 V for a period of 10 minutes. The forward bulkhead 28 carries an autopilot unit 50 which is connected by leads 52 to a towing rope angle sensor 54 mounted to the middle bulkhead 30. A motor 56 is mounted in the bulkhead 30 and drives a gearbox 58 containing four bevel gears that serve to drive a pair of coaxial contra-rotating output shafts 60 that pass through stern gland 62 on aft bulkhead 32 and through nozzle-defining partition 64 in flooded stern compartment 40 where they drive twin contra-rotating propellers 66, 68. The gearbox 58 may be dispensed with if the motor 56 is itself in two contra-rotating parts like the motors of many torpedoes. Although the use of contra-rotating propellers is preferred on the ground of efficiency, a single propeller can be used provided that adequate thrust is obtainable from it. Inlets 70 in the lower sides of the casing of compartment 40 allow water to flow to the propellers 66, 68. The use of a nozzle or jet in which ducted propellers 66, 68 run facilitates station keeping while the tug 20 is not moving and maximises pull with the tug stalled so that the full power of the tug is available to tow the lifecraft 14 on launch thereof. A rudder 72 is pivoted aft of propeller 68 with its angular position being set by servo 74 controlled from the autopilot 50. A recovery handle 76 of inverted V-shape is attached to the casing in register with forward compartment 36.

A V-shaped keel 79 is attached along the underside of the casing 26 and may contain the position servo 74 for the rudder 72, leads (not shown) from the autopilot 50 to the servo 74, and ballast if required. A flotation jacket 78 generally of inverted U-profile is secured above and along the casing 26 and is made of expanded plastics material with a soft core of flexible polyethylene foam skinned with polyurethane. The volume and density of the flotation jacket is selected so that the tug 20 has a suitable low waterline as shown in FIG. 5 to minimize the effects of wave action and the combination of the buoyant flotation jacket 78 and the keel 79 gives good stability and self-righting properties. Furthermore, the resilience of the jacket 78 makes the tug 20 self-fendered. Extending aft from the bows aperture 42 is a vertical channel 81 through the jacket 78 which serves to lead the towing cable 22 to an aft-facing steerable fairlead 83 positioned at or as close as possible to the center of neutral steer. The fairlead 83 releaseably retains the cable 22 while responding to the angle that aft portion 22*a* thereof makes with the fore and aft direction of the tug 20. Thus the fairlead 83 may have retaining means such as a pair of split rings that remain closed until opened by a trigger mechanism controlled by a timer, or the fairlead may be jettisoned after a predetermined time. A spindle 85 operably connects the fairlead 83 with the angle sensor 54.

Figure 6:
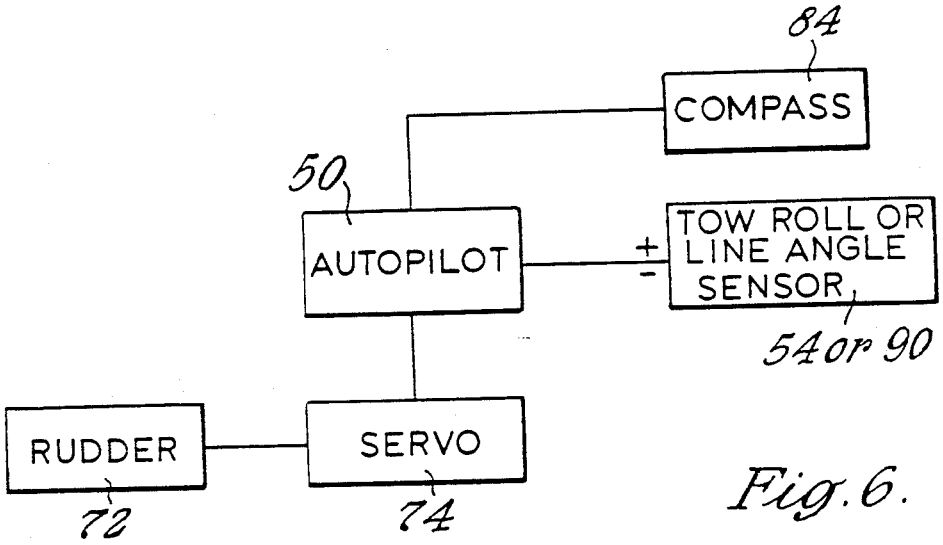
FIG. 6 is a block diagram of station keeping means fitted in the tug of FIGS. 3 to 5.
Figure 7:
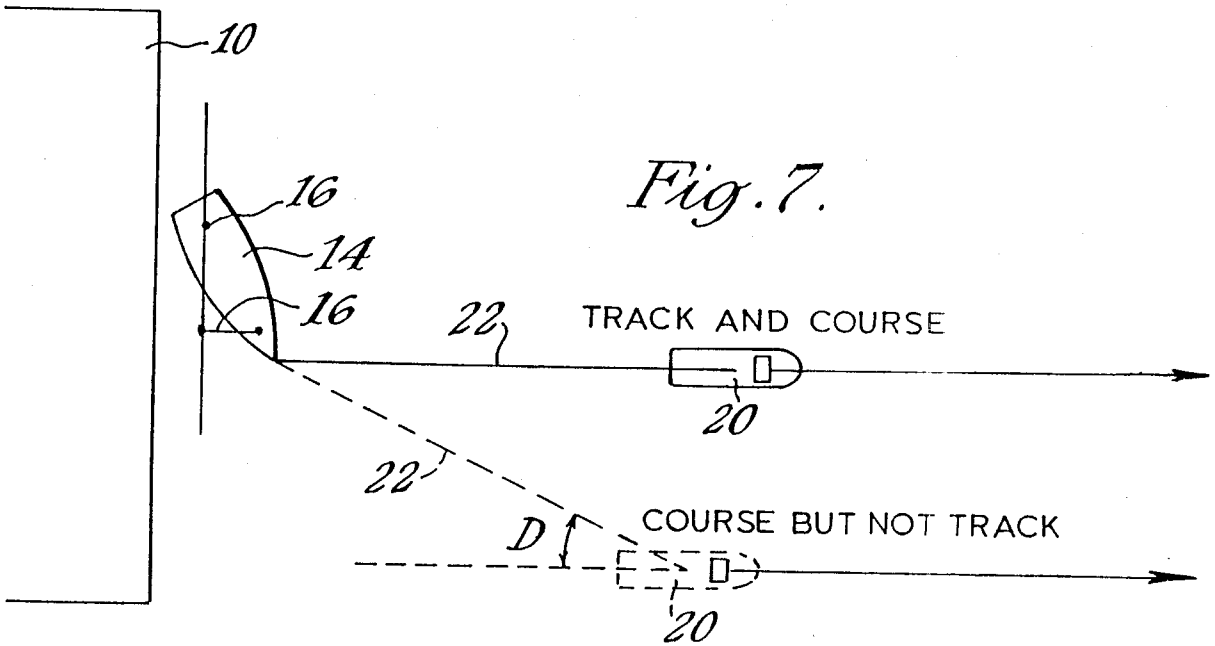
FIG. 7 is a diagram showing the effects of the tug proceeding on a correct course but off track.

Referring now to FIGS. 6 and 7, the autopilot 50 receives input signals from the tow line sensor 54 and from magnetic or gyroscopic compass means 84. Thus in FIG. 1*b*, before the boat 14 is afloat the tug 20 heads away from the platform 10 at a predetermined compass heading set in response to compass 84, but when the boat is afloat (FIGS. 1*c* and 7), if the aft towline portion 22*a* deviates from the fore-and-aft direction as indicated by fairlead 83 and sensor 54 a helm correction signal is fed to autopilot 50 to bring the boat 14 back onto the correct track. In FIG. 7 the dotted lines show the tug 20 on the correct course but on the wrong track as indicated by an angle D between the cable 22 and the fore and aft direction. The action of the sensor 54 and autopilot 50 is to reduce angle D to a minimum, bringing tug 20 onto the correct track which is indicated by solid lines. It will be appreciated that the above launching system is compact but meets the operational requirement of guiding the lifecraft 14 away from the platform 10 on a predetermined safe heading in the period immediately after launch.

Figure 8:
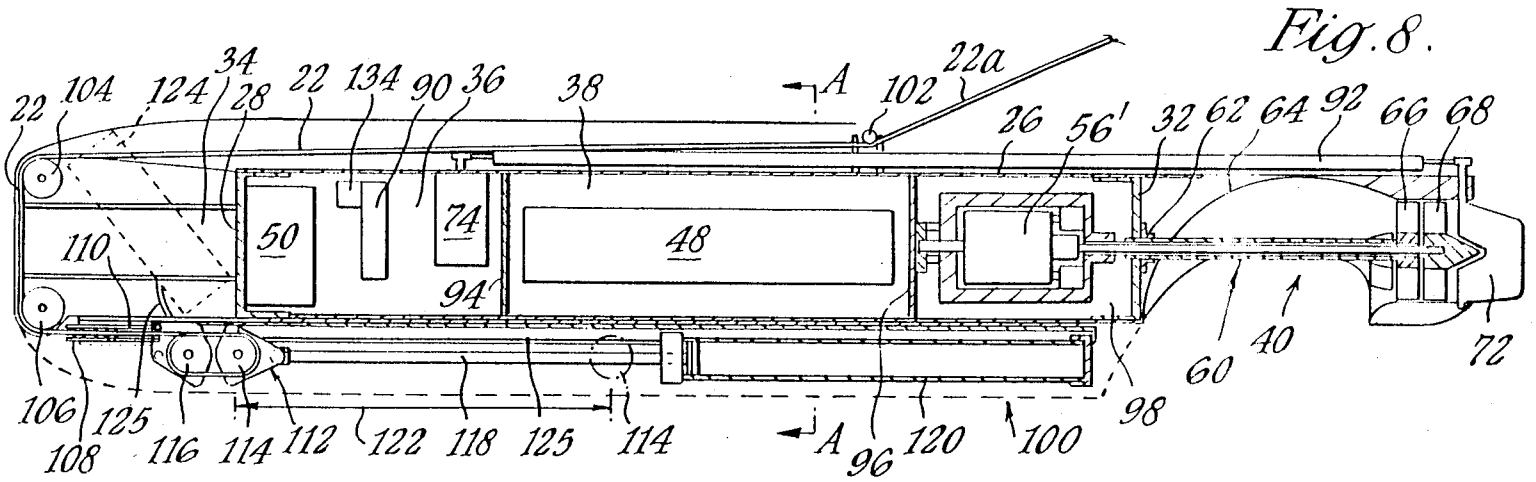
FIGS. 8, 9 and 10 are respectively a center line sectional elevation, an underside view and a section on the line A—A of FIG. 8 of a second embodiment of a tug forming part of a launching system according to the invention.
Figure 9:
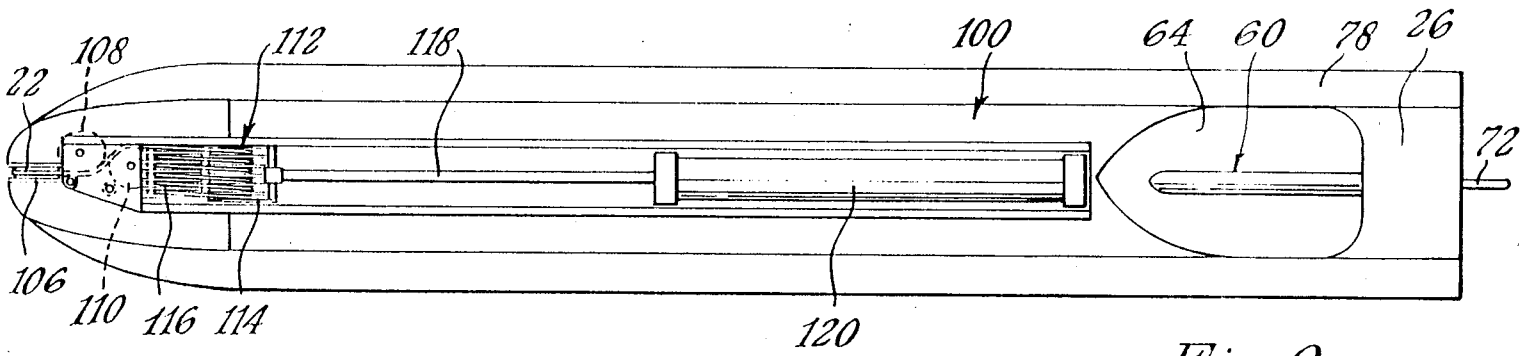
Figure 10:
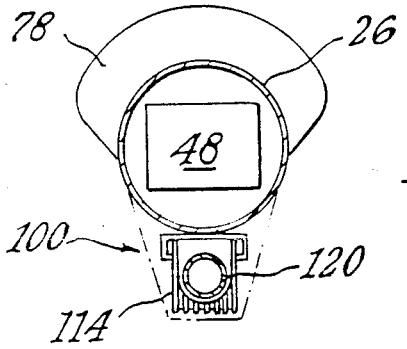
Figure 11:
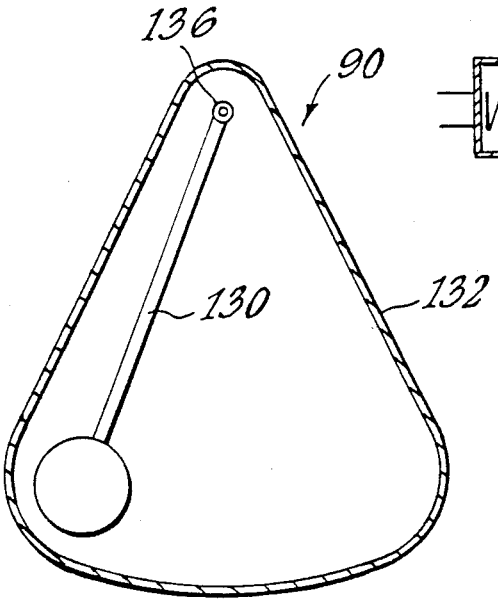
FIGS. 11 and 12 are respectively longitudinal and transverse sections of a damped pendulum unit fitted into the tug of FIGS. 8 to 10.
Figure 12:
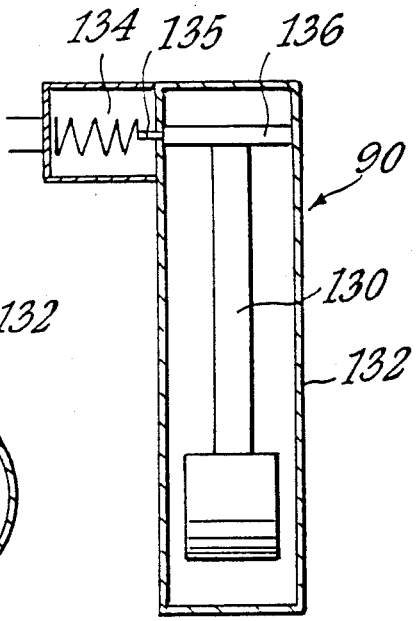

A preferred form of the tug 20 is shown in FIGS. 8 to 10 and comprises a casing 26 in a flotation jacket 78 as previously described. A forward compartment 36 of the casing 26 behind a bulkhead 28 houses an autopilot unit 50, a roll pendulum unit 90 for providing an input signal to the autopilot 50 and steering servos 74 connected by cables 92 to the rudder 72. A bulkhead 94 divides the forward compartment 36 from aft compartment 38 which houses a 100 volt 65 ampere-hour battery 48. A bulkhead 96 divides aft compartment 38 from motor compartment 98 which houses a 50 HP contra-rotating motor 56' which drives propellers 66, 68 via a pair of concentric output shafts 60 as previously described. The keel 100 houses a mechanism that is capable of paying out and recovering a predetermined length (suitably 60 feet) of the towing cable 22. The rope 22 passes from a fairlead 102 at the center of neutral steer of the tug 20 forwardly over upper and lower bow guide sheaves 104, 106 to a pair of lead sheaves 108, 110 and thence to an end sheave 112 of a 6-sheave block 114 which is mounted on rod 118 of an hydraulic ram 120 in the keel 100 located approximately under bulkhead 98. The cable 22 passes over the sheaves of the six sheave block 114 and over the sheaves of a fixed five sheave block 116 located under the bows compartment 34. Between the sheaves 104, 106 the cable 22 runs vertically, the lead sheaves 108, 110 deviate the cable 22 in a horizontal plane from the longitudinal center line of the tug 10 to align the cable 22 with end sheave 112 of the movable block 114. Between the sheaves of blocks 114, 116 the cable 22 is stowed in vertical loops. The rod 118 has a travel of five feet as indicated by the arrow 122, the aft position of the block 114, corresponding to stowage of the tow rope 22, being shown by the dotted circle. With this travel the six loops of cable 22 in the keel 100 can pay out and recover 60 feet of cable. The rod side of ram 120 is connected by line 125 to a pair of hydraulic accumulators 124 in the bows compartment 34 with the combined working volume of accumulators 124 preferably being more than twice the working volume of the ram 120. Typically the accumulators 124 are pressurised to 2000 psi and have a combined working volume of 10 gallons whereas the ram 120 has a working volume of about 3 liters. With this arrangement tension in rod 118 and hence the tension in towing cable 22 varies only slightly through the stroke of ram 120.

With this arrangement when the tug 20 is stowed on its davit 18 the rod 118 of the ram 120 is retracted and the 60 foot recoverable section of towing cable 22 is stowed in the keel 120 of the tug. A further length of cable 22 interconnects the tug 20 with the survival craft 14, that further cable being of length at least equal to the distance that tug 20 has to fall before it hits the water (FIG. 1*a*–FIG. 1*b*) and is stowed at any convenient location where it is freed and deployed automatically as the tug 20 falls to the water. As the craft 14 reaches its lowered position (FIG. 1*c*) the tug 20 has travelled to the end of the free length of cable 22 and a further distance corresponding to deployment of the stowed 60 foot length of cable 22, the cable pulling block 114 forward and extending rod 118 with fluid being fed into hydraulic accumulators 124. Tension in the cable 22 pulls the craft 14 towards a correct heading (FIG. 1*c*). As the falls are released and in the initial 60 feet of travel of the craft 14 the tug 20 is substantially still in the water and acts as a sea anchor, the travel of the craft 114 towards the tug 120 allowing the deployable portion of the cable 22 to be rewound onto the sheaves of blocks 114, 116 as rod 118 retracts, hydraulic fluid returning from accumulators 124 to ram 120. To enable this deployment and recovery to happen an appropriate balance is required between the forward pull at line 22 from the action of motor 56' and propellers 66, 68 which may be of the order of 500 lbs with the tug 20 still in the water and the pull in the deployable section of the towline exerted through ram 120 which is somewhat less, typically of the order of 480 lbs. The reason for using the tug 20 as a sea anchor and recovering a deployable portion of cable 22 during the first part of travel of craft 14 from the platform 10 is that the thrust from propellers 66, 68 is the greatest when the tug 20 is still in the water and falls off rapidly as the tug begins to move forward and with the tug 20 still the whole of the available towing force is applied in line 22 to accelerate the craft 14 away from the platform 10.

It will be noted that the cable 22 passes through a simple fairlead 102 as opposed to the sheerable fairlead 83 of the earlier embodiment. Deviation of the cable 22 from the fore and aft direction of the tug 20 gives rise to a roll to port or starboard depending on the angle D (FIG. 7) which is a permanent component superimposed on the roll imparted to tug 20 by wave action. The permanent component of tug roll is sensed by pendulum 130 of the roll pendulum unit 90 whose motion is damped by oil in pendulum casing 132. The autopilot 50 has a trim control 134 which is a potentiometer whose shaft 135 is rotatable clockwise or anti-clockwise to cause servo 74 to angle rudder 72 to port or starboard in addition to the rudder angle called for by the compass heading. The pendulum 130 is pivoted on a shaft 136 which is coupled to the potentiometer shaft 135. Since the towing cable 22 leaves the tug 20 at fairlead 102 which is located above the roll center the force in the towing cable 22 will roll the tug 20 clockwise or anti-clockwise as the tug tracks to port or starboard of a bearing set on the auto-pilot 50 from the stowed position from which the tug 20 was launched. An internal compass in autopilot 50 maintains the tug on course and the pendulum 130 and trim control 134 keep the tug 20 on track while the lifecraft is being lowered but is not released from the falls.

I claim:

1. A marine survival system for a vessel (including a marine platform) comprising:

a lifecraft;

an unmanned tug having a bow and a stern between which is defined a fore-and-aft direction of said tug;

a towline connected between the bow of the lifecraft and a center of neutral steer of the tug;

a first launching means by which the lifecraft is stowed on the vessel, said first launching means including releasable falls and braked winch means controlling pay-out of the falls so that the lifecraft is lowered slowly to the sea;

a second launching means by which the tug is stowed on the vessel, said second launching means including a release permitting the tug to drop to the sea;

autopilot means in said tug operatively connected to a rudder of the tug to angle the rudder as called for by a predetermined compass heading;

a sensor in the tug responsive to a direction of pull in the towline and having an output a state of which changes depending upon a magnitude and a direction of a deviation of said pull from the fore and aft direction of the tug;

a trim control of the autopilot means responsive to the state of the sensor output to adjust an effective compass heading to maintain the tug on a predetermined track relative to the lifecraft; and release means operably connected to the winch means and to the tug release so that on actuation of the release means the tug falls into the sea and deploys to an extremity of the towline on the predetermined compass heading and track as the lifecraft is slowly lowered to the sea and on release of the falls tows the lifecraft away from the vessel.

2. A system according to claim 1, wherein the tug is stowed on a platform and is launched therefrom in a bows-out attitude.

3. A system according to claim 1, wherein at least part of the towline is carried on a reel that offers controlled resistance to deployment to reduce shock loads as full deployment of the towline is reached.

4. A system according to claim 3, wherein the towline is stored in the bows of the tug.

5. A system according to claim 4, wherein the towline passes to fairlead means located at the center of neutral steer of the tug and pivoted for rotation about a vertical axis, said fairlead means following an angle between towline trailing the tug and the fore and aft direction of the tug, so that an angular position of the fairlead means signifies the direction of pull in the towline.

6. A system according to claim 1, wherein the tug has propulsion means including batteries supplying current to an electric motor having a pair of concentric output shafts connected to a pair of contra-rotating propellers in a ducted aft compartment of the tug.

7. A system according to claim 6, wherein said batteries, motor and duct are housed in a tubular body running the length of the tug, and the tug is fitted with a keel and with a flotation jacket of expanded plastics material also serving as a fender for the tug.

8 A system according to claim 1, wherein the towline leaves the tug at a point above a roll center of the tug so that pull in the towline rolls the tug clockwise or anti-clockwise as the towline passes to starboard or port of the fore and aft direction of the tug, damped pendulum means in the tug senses the roll of the tug and the trim control responds to the angular position of the damped pendulum means.

9. A system according to claim 1, wherein means in the tug is provided for paying out and recovering a portion of the towline and means biases the towline payout means in a recovering direction while towline is paid out to maintain a tension therein which is less than the pull of the tug when the tug is still in the water so that the towline is paid out as the lifecraft is lowered and the towline is recovered during an initial movement of the lifecraft with the tug substantially still in the water.

10. A system according to claim 9, wherein the towline is stowed in the tug between sheaves of first and second sheave blocks, a ram has a rod connected to the first sheave block for movement towards and away from the second sheave block and the ram is connected to hydraulic accumulator means to supply fluid to the hydraulic accumulator means as the rod is extended so that the accumulator biases the rod towards return into the ram.

11. A system according to claim 1, wherein means in the tug is provided for paying out and recovering a portion of the towline, said means comprising first and second sheave blocks between which the towline is stowed and means biasing said blocks apart for recovery of the portion of the towline, said biasing means maintaining a tension in said towline which is less than the pull of the tug when the tug is still in the water so that the towline is paid out as the lifecraft is lowered and is recovered during an initial movement of the lifecraft with the tug substantially still in the water.

12. An unmanned tug for incorporation into a marine survival system which when dropped into the water deploys at an end of a towline on a predetermined heading and track relative to a lifecraft, said tug having autopilot means therein operatively connected to a rudder of the tug to angle the rudder as called for by a predetermined compass heading, a sensor in the tug responsive to a direction of pull in the towline to change state depending upon the magnitude and direction of a deviation of said pull from a fore and aft direction of the tug, a trim control of the autopilot means responsive to the state of the sensor to adjust an effective compass heading to maintain the tug on the predetermined track relative to the lifecraft, means in the tug for paying out and recovering a portion of the towline and means biasing the towline payout means in a recovery direction while towline is paid out to maintain a tension therein which is less than a pull of the tug when the tug is still in the water so that in use of the tug the towline is initially paid out and as the survival craft starts to move towards the tug said portion of the towline is recovered into the tug with the tug substantially still in the water.

13. A tug according to claim 12, wherein the towline is stowed in the tug between sheaves of first and second sheave blocks, a ram has a rod connected to the first sheave block for movement towards and away from the second sheave block and the ram is connected to hydraulic accumulator means to supply fluid to the accumulator as the rod is extended, the hydraulic accumulator means biasing the rod to return into the ram.

14. A tug according to claim 13, wherein the towline leaves the tug at a point above a roll center of the tug so that pull in the towline rolls the tug clockwise or anticlockwise as the towline passes to starboard or port of the fore and aft direction of the tug, damped pendulum means in the tug senses the roll of the tug and the trim control responds to the angular position of the damped pendulum means.

15. A tug according to claim 14, wherein batteries motor propellers and duct are housed in a tubular body running the length of the tug, the tug is fitted with a keel and with a flotation jacket of expanded plastics material also serving as a fender for the tug.

16. A tug according to claim 15, wherein the first and second sheave blocks and the ram are located in the keel of the tug.

17. A tug according to claim 16, wherein the towline passes from a fairlead at the center of neutral steer of the tug into the keel of the tug via first and second sheaves at the bows of the tug spaced vertically apart and third and fourth sheaves in the keel for displacing the towline across the tug into alignment with an end sheave of the first sheave block.

* * * * *